US005101845A

United States Patent [19]

Kravetz

[11] Patent Number: 5,101,845

[45] Date of Patent: Apr. 7, 1992

[54] CARRYING DEVICE ATTACHABLE TO A CRUTCH

[76] Inventor: David A. Kravetz, 23 E. Kaler Dr., Phoenix, Ariz. 85020

[21] Appl. No.: 719,397

[22] Filed: Jun. 24, 1991

[51] Int. Cl.[5] ..... A45B 3/00

[52] U.S. Cl. ..... 135/66; 135/68; 248/311.2; 224/42.45 R

[58] Field of Search ..... 135/68, 72, 76, 66; 248/311.2, 205.2; 224/42.45, 35, 32 R, 39, 148

[56] References Cited

U.S. PATENT DOCUMENTS

| | | | |
|---|---|---|---|
| 875,482 | 12/1907 | Wyatt | 135/68 X |
| 1,181,942 | 5/1916 | Underwood . | |
| 2,151,293 | 3/1939 | Dross | 135/68 |
| 2,423,635 | 7/1947 | Blum . | |
| 2,553,730 | 5/1951 | Taylor . | |
| 2,640,596 | 6/1953 | Reeder . | |
| 3,317,171 | 5/1967 | Kramer | 248/311.2 X |
| 3,429,541 | 2/1969 | Herman . | |
| 3,429,542 | 2/1969 | Fagan . | |
| 3,616,977 | 11/1971 | Zurmuhlen | 224/32 R |
| 3,985,148 | 10/1976 | Cadman . | |
| 4,289,156 | 9/1981 | Ulics . | |
| 4,437,596 | 3/1984 | Shook | 224/32 R X |
| 4,583,262 | 4/1986 | Werner . | |
| 4,830,240 | 5/1989 | Tackles et al. | 224/35 |
| 4,850,383 | 7/1989 | McBride . | |
| 4,932,626 | 6/1990 | Guillot | 248/205.2 X |
| 4,934,646 | 6/1990 | Doyle | 248/205.2 X |

FOREIGN PATENT DOCUMENTS

| | | | |
|---|---|---|---|
| 142453 | 7/1935 | Austria | 248/311.2 |
| 2229234 | 12/1974 | France | 248/311.2 |
| 72540 | 9/1947 | Norway | 224/35 |

*Primary Examiner*—David A. Scherbel
*Assistant Examiner*—Lan Mai
*Attorney, Agent, or Firm*—Ronald W. Kock

[57] ABSTRACT

Clamping device attachable to the side of a crutch for carrying thin, flat, non-rigid articles or a 12 oz. beverage can, having a preload to firmly hold articles in place. The device is attachable to a variety of crutch frame cross-sections and widths by a single bracket at the top of the device connected to the crutch handgrip bolt by a wingnut. At least one adjustable strap prevents the lower end of the device from pivoting away from and banging against the crutch frame. One embodiment comprises an L-shaped member and a spring-biased hinged member connected to and preloaded against the L-shaped member for clamping articles therebetween. In another embodiment a molded plastic J-shaped member has a thinned portion at the base of the short leg of the J to provide resiliency. A spacer between the outer end of the resilient short leg and the clamp surface of the rigid long leg provides a preload force between them. Alternatively, an adjustably slidable connection between overlapping parts of the J-shaped clamp enables preloading without the spacer.

18 Claims, 6 Drawing Sheets

CARRYING DEVICE ATTACHABLE TO A CRUTCH

FIELD OF THE INVENTION

The present invention relates to carrying devices and more particularly to carrying devices attachable to crutches. Even more particularly, the present invention relates to clamp-type carrying devices which are attachable to crutch members having a variety of cross-sections.

BACKGROUND OF THE INVENTION

Productive adults are often injured during their leisure activities, such as in skiing accidents. In many cases they suffer injuries requiring the temporary use of crutches for mobility. Crutches most commonly used during rehabilitation of such injuries are of the "Y" design. Such a crutch frame has two members that converge near the bottom and attach to a central leg member. The two frame members are spread apart at the top to support an under-arm brace. Horizontally opposing sets of holes in the frame members permit a handgrip to be attached between the frame members by a bolt and wingnut. Handgrip position is adjustable vertically for arm length by selecting the appropriate set of bolt holes. The central leg is similarly adjustable vertically in order to adapt the crutch to the user's height. There are at least four different types of "Y" crutches on the market, distinguishable by different frame cross-sections and materials of construction.

In order to continue performing their jobs, and even for everyday living, crutch users frequently have to carry a newspaper, documents, notepads, folders, mail, an address booklet, and similar articles found in both the home and business settings. Crutch users have considerable difficulty hand-carrying articles while simultaneously supporting themselves on a pair of crutches. Each crutch has a handgrip which the user grasps to both lean on and manipulate the crutch. While moving around on crutches, the user needs a method other than hand-carrying to transport even the smallest articles. A carrying device attached to one of the crutches can be of significant benefit to a productive adult, especially if it is capable of supporting articles found in the business setting, such as papers, folders, legal pads, and other predominantly thin, flat, and non-rigid articles.

Increasingly common in the business setting are metal 12 oz. beverage cans for single-service cold beverages, available from vending machines. With the popularity of vending machines in office complexes and other work facilities, a carrying device attachable to a crutch, which not only supports business items, but which also supports an open 12 oz. beverage can, is highly desirable. Also of benefit is a carrying device which can be conveniently attached without tools to a wide variety of commercial crutch frames, and which is not so bulky as to limit the user's access through doorways or to knock things over.

Although carrying devices attachable to a crutch are well known in the art, many are deficient in some respect. U.S. Pat. No. 3,429,541 to Herman, for example, shows a wire frame attachment which connects to handgrip adjusting holes below the handgrip, for carrying books, parcels, and other large objects. Although preferably made of resilient spring steel and coated with rubber, such a carrier has no way of clamping thin or small items because there is nothing to clamp against.

The outermost end of the bent wire frame is centered between the two crutch frame members, requiring an article to be large and rigid so that both frame members resist the clamping force applied by the wire frame. A non-rigid article like a notepad would easily bend and avoid being clamped. Since the device is intended to be mounted in the handgrip holes below the handgrip, the lowermost position of the handgrip is unavailable. Mounting a carrying device above the handgrip is generally not feasible because articles then interfere with grasping the handgrip.

U.S. Pat. No. 4,850,383 to McBride has a flexible bag-type carrier mounted between the crutch frame members, hanging from the handgrip by means of string ties or straps. While intended for smaller articles, McBride's carrying device is not useful for carrying legal size notepads and the like, where folding is either impractical or undesirable. In addition, McBride's carrier is designed to fit into the converging part of the crutch frame. Lower straps connect to the smaller girth of the converging part of the frame. The handgrip is then positioned by the length of the bag, and thus may not be adjustable for different user heights. Also, some crutches have the adjustable central leg member extending between the converging frame members where it could interfere with McBride's carrier.

U.S. Pat. No. 4,289,156 to Ulics shows a rigid bucket-like carrier attached at the side of a crutch by an extended handgrip bolt passing through two carrier support brackets and secured by a handgrip wingnut. Papers, books, and many other articles could be carried by such a device. However, the size of such a container, to carry a legal pad, for example, may be a nuisance to crutch manipulation. Also, because long objects like legal pads would likely be supported vertically to keep the carrier small, interference with crutch handgripping may occur. When the crutch is swung back and forth during walking, the rigid container provides no support to loose papers which may blow or fall out. Attachment of the two brackets of this carrier, by using a bolt extending through the handgrip and crutch frame, requires a longer bolt than typically comes with the crutch. The apparent need for hardware replacement lacks convenience for attaching this carrier system. Also, the two brackets must be adjusted relative to each other for different crutch frame widths.

An example of another type of crutch attachment for carrying articles is U.S. Pat. No. 2,553,730 to Taylor. This patent shows a device attached to a crutch frame at one end, having an elastic means encircling a package or other rigid article resting on a shelf of the device. The other end of the elastic means is attached to the crutch, thereby securing the encircled package tightly against the crutch. Similar to other prior art carrying devices, this device is not appropriate for carrying thin, non-rigid articles or open beverage cans commonly found in a business environment. By being mounted between the converging portion of the crutch frame, the carrier's use is limited by crutch shape. Even if it fits, its position relative to the adjustable handgrip is variable. The user may have difficulty reaching articles within this carrier when the handgrip is positioned high in the crutch frame.

Still another type of crutch attachment was observed by the inventor of the present invention. It consisted of three metal spring clips taped to the sides of the crutch frame members, one facing upward toward two others facing downward. The three clips were spaced to hold objects the size of notepads. Each clip had an independent finger grip for opening it. Clips had to be sequentially opened for each article to be either inserted or removed. While useful for carrying business papers, this device was limited as to the size and weight of articles it could support. Clips taped to crutch frame members were frequently dislodged, and spacing adjustment for different sized articles was quite inconvenient. However, the use of common spring clips demonstrated the need for a device attachable to a crutch for carrying those articles found in a business setting.

OBJECTS OF THE INVENTION

In light of the above, an object of the present invention is a carrying device for a crutch which will support thin, flat, non-rigid articles commonly found in business settings, without requiring or causing such items to be folded, and without the need for carrier adjustment to compensate for differences in article size.

Another object of the present invention is a carrying device for a crutch which will securely support an open 12 oz. beverage can upright and without crushing it.

Yet another object of the present invention is a carrying device which is conveniently attachable to a wide variety of crutch frames without replacement parts or tools.

Still another object of the present invention is a carrying device mounted relative to the handgrip of a crutch such that the full range of crutch length and handgrip position adjustments do not cause the carrier or articles held by it to interfere with grasping the crutch handgrip.

SUMMARY OF THE INVENTION

In practicing the present invention a clamping device is attached to the side of a crutch to carry thin, flat, non-rigid articles or an upright 12 oz. beverage can without crutch user contact, thereby enabling the crutch user to freely manipulate the crutch by its handgrip without concern for losing the articles or spilling the beverage. By maintaining a spring preload, the clamping device firmly holds the thinnest article or a beverage can without crushing it.

The clamping device is attachable to a variety of crutch frames without tools or replacement parts. A single bracket connects the device to the existing crutch handgrip bolt via the existing crutch wingnut, spacing the clamp a fixed distance below the handgrip. Regardless of crutch length or handgrip adjustments, the clamping device itself, and any articles it holds less than 10 inches wide, will not interfere with the user's grasping the handgrip. The use of a single attachment point permits the device to be adaptable to a variety of crutch designs, with round or rectangular frame member cross-sections and varying crutch widths. At least one flexible strap, adjustable in connecting length and position, secures the lower end of the clamping device to the crutch frame so that the lower end will not pivot outwardly from the crutch and bang against it when walking with the crutch.

In one preferred embodiment of the present invention the carrying device comprises a molded and post-formed plastic J-shaped member having the shorter leg angled toward the center of the longer leg. A small gap between the outer end of the shorter leg and the flat face of the longer leg is provided for forming purposes. A thinned portion at the bottom of the shorter leg enables the shorter leg to flex relative to the rigid longer leg. At least one spacer member, attached to either or both the outer end of the shorter leg or to the clamp surface of the longer leg, more than filling the small gap, creates a preload force between the legs to form a clamp. A finger grip extends from the shorter leg for opening the clamp in order to insert or remove articles to be carried. A single bracket at the top of the longer leg allows connecting the carrying device to a crutch frame at the handgrip bolt, and at least one adjustable strap allows the lower portion of the longer leg to be held against the outside of the crutch frame to prevent the device pivoting about its single attachment point.

The shorter leg preferably has a semicircular protrusion in its center forming a concave recess facing the vertical portion of the J-shaped member. The concave recess contacts about a 105° arc of a cylindrical 12 oz. beverage can placed in the recess. The recess has a curvature substantially equivalent to that of the can. At the outer, clamping end of the shorter leg, the recess is open so that the beverage can may extend above the clamp. Near the thinned portion of the shorter leg, a ledge substantially perpendicular to the recess supports the bottom of the can. The spacing between the shorter leg and the longer leg at the thinned portion, and the depth of the recess, have a total that align the shorter leg substantially parallel to the vertical portion of the J-shaped member when a beverage can is clamped between them. This arrangement maximizes the contact area between the shorter leg and the can in order to minimize crushing forces against the can.

Alternatively, the J-shaped member may be constructed of two parts formed separately, which overlap and are bolted together at the bottom of the J. The two parts are slidably adjustable substantially perpendicular to the clamping surface at bolt slots so that preloading is accomplished by adjustment of one part toward the other rather than by spacer plates.

In a second preferred embodiment of the present invention the carrying device comprises a rigid, upright L-shaped member; a member hinged from the horizontal end of the L with its outer end angled upward and biased against the center of the vertical portion of the L by a spring to form a clamp; a finger grip extending from the hinged member for opening the clamp in order to insert or remove articles to be carried; a single bracket at the top of the L for connecting the carrying device to a crutch frame at the handgrip bolt; and at least one adjustable strap for holding the lower vertical portion of the L against the outside of the crutch frame to prevent the device from pivoting about its single attachment point.

DETAILED DESCRIPTION OF THE INVENTION

Figure 1:
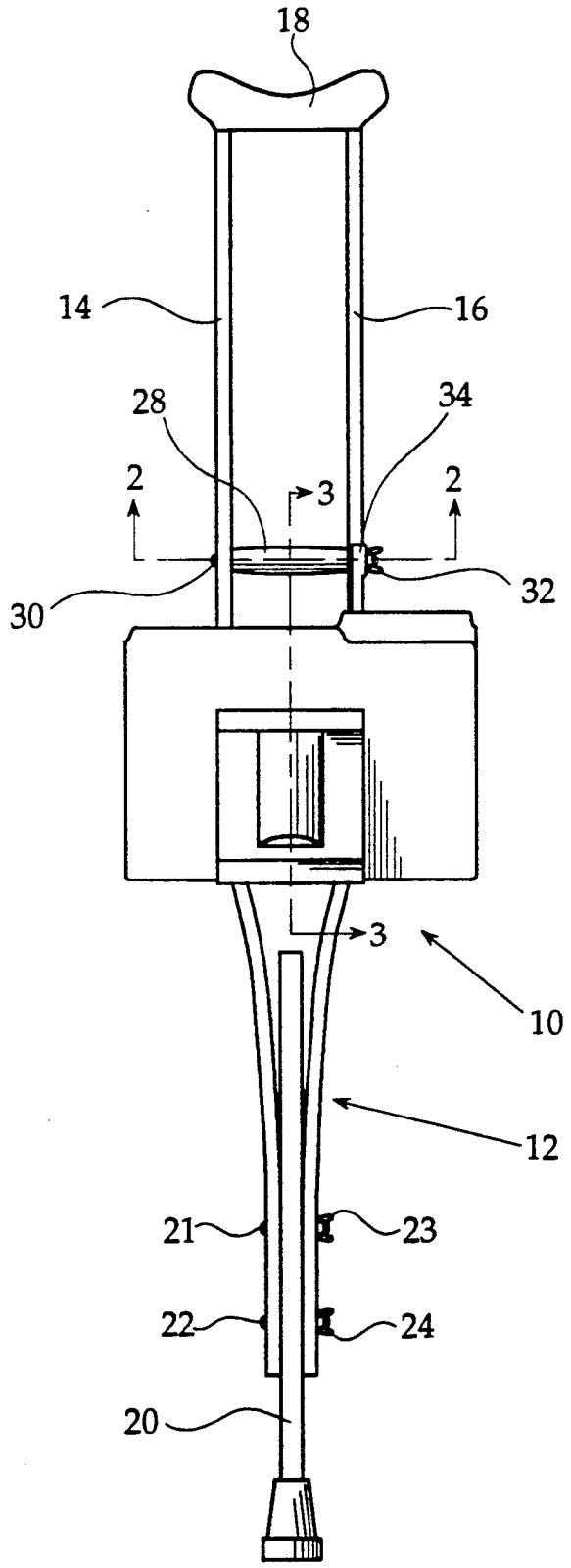
FIG. 1 is a front elevation view of a preferred embodiment of the present invention attached to a conventional crutch, disclosing a carrying device holding a folder.

Referring now to the drawings, and more particularly to FIG. 1, there is shown a first preferred embodiment of the present invention, generally indicated as 10. Carrying device 10 is connected to a conventional crutch 12. Crutch 12 has two frame members 14 and 16. Attached to the top of frame members 14 and 16 is under-arm brace 18 for the crutch user to lean on. At about the center of crutch 12, frame members 14 and 16 converge so that they may be connected to a central leg member 20 by a pair of bolts 21 and 22 and wingnuts 23 and 24. Leg member 20 has several sets of horizontal holes, not visible in FIG. 1, which permit it to be attached to frame members 14 and 16 at different positions, thereby enabling crutch 12 to be adjusted in height for different users. Between brace 18 and the converging of frame members 14 and 16 is handgrip 28, connected to the frame members by bolt 30 and wingnut 32. Handgrip 28 is also adjustable vertically by moving bolt 30 to one of several sets of horizontal holes, not visible in FIG. 1, extending through frame members 14 and 16.

A variety of conventional crutch designs of this "Y" configuration are available commercially. Some have round metal tubular frame and leg members. Others have rectangular cross-section wooden frame and leg members. The widths of different crutch designs vary. In many designs bolt 30 extends beyond wingnut 32 by 5 to 10 millimeters. The bolt extension permits a single thin bracket 34 of carrying device 10 to be clamped on bolt 30 between wingnut 32 and frame member 16 without having to replace bolt 30 with a longer bolt. The single bracket permits the carrying device to be attached independently of overall crutch width. By being attached to the same bolt as handgrip 28, carrying device 10 is always positioned a fixed distance below handgrip 28 such that articles carried do not interfere with grasping handgrip 28. Also, this fixed distance enables the user to easily reach articles in the carrying device when the handgrip is properly positioned for user arm length.

Figure 2:
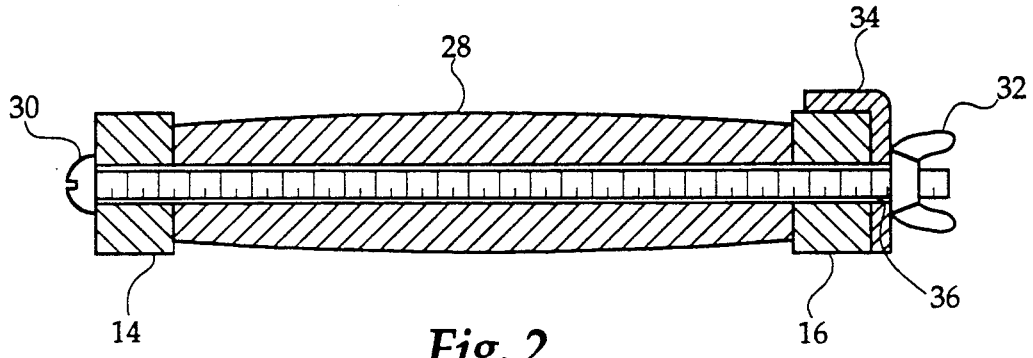
FIG. 2 is a sectioned view, taken along section line 2—2 of FIG. 1, showing the single bracket of the carrying device attached to the handgrip bolt of a crutch with rectangular cross-section frame members.

FIG. 2 shows carrier bracket 34 having hole 36 aligned with one of the pair of handgrip adjustment holes in frame members 14 and 16, and with the hole through handgrip 28. Bolt 30 passes through the aligned holes with its head abutting frame member 14. At the other end of bolt 30 is wingnut 32 tightened on bolt 30 to clamp together frame members 14 and 16, handgrip 28, and carrier bracket 34. Frame members 14 and 16 are shown having a rectangular cross-section, common for wooden crutches.

Figure 2A:
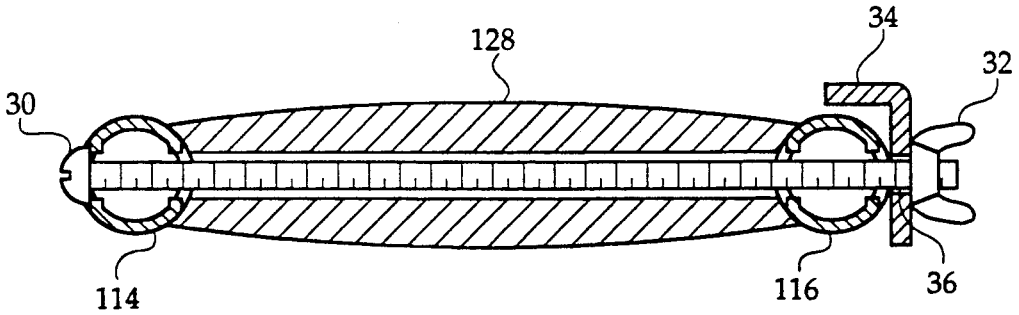
FIG. 2A is an alternative sectioned view, taken along section line 2—2 of FIG. 1, showing the single bracket of the carrying device attached to the handgrip bolt of a crutch with tubular frame members.

FIG. 2A shows the same carrying device attachment elements as FIG. 2, except that the frame members 114 and 116 of FIG. 2A are circular metal tubes instead of rectangular wooden members. Bracket 34 is sized to fit either type crutch frame member. Handgrip 128 is adapted to fit members 114 and 116.

Figure 3:
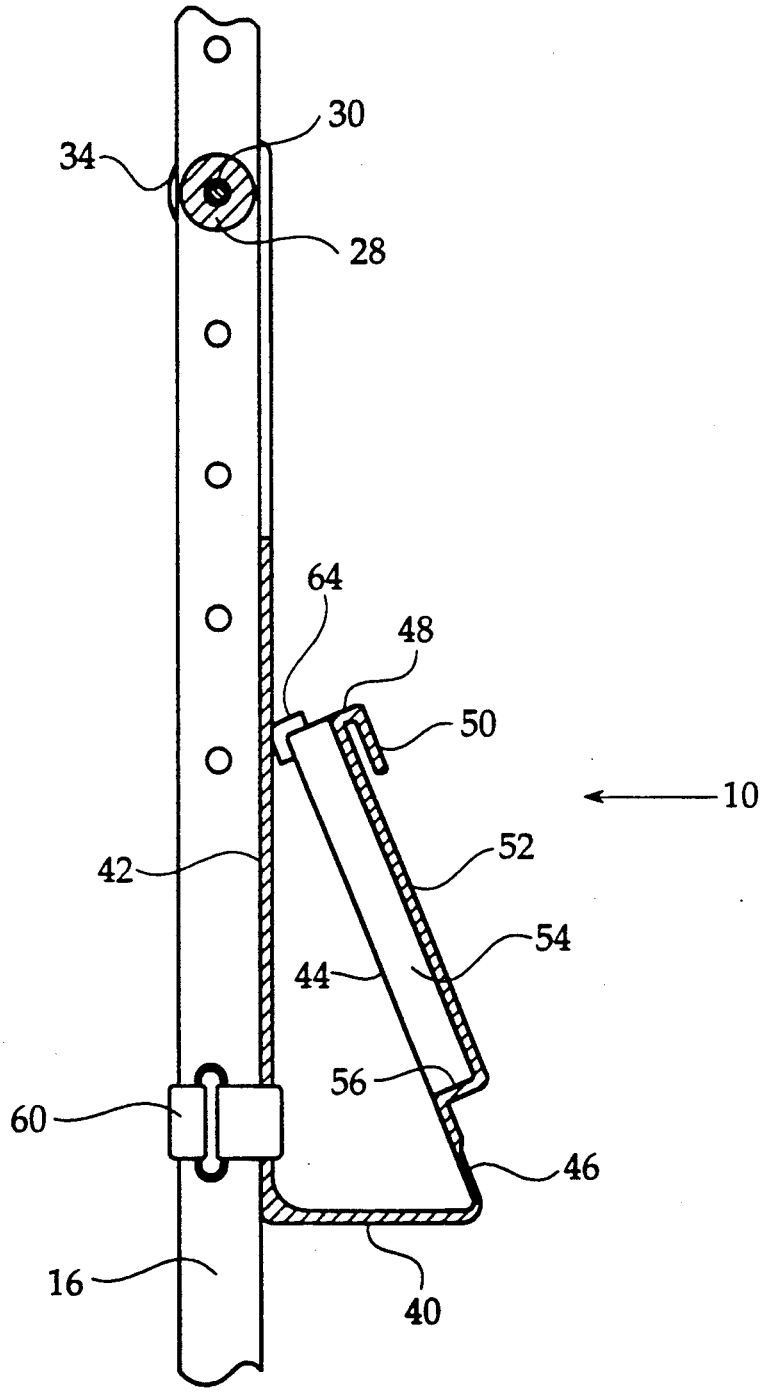
FIG. 3 is a sectioned side elevation view, taken along section line 3—3 of FIG. 1, showing an empty carrying device secured from pivoting about the handgrip bolt by a strap holding the lower end of the device to a crutch frame member.
Figure 4:
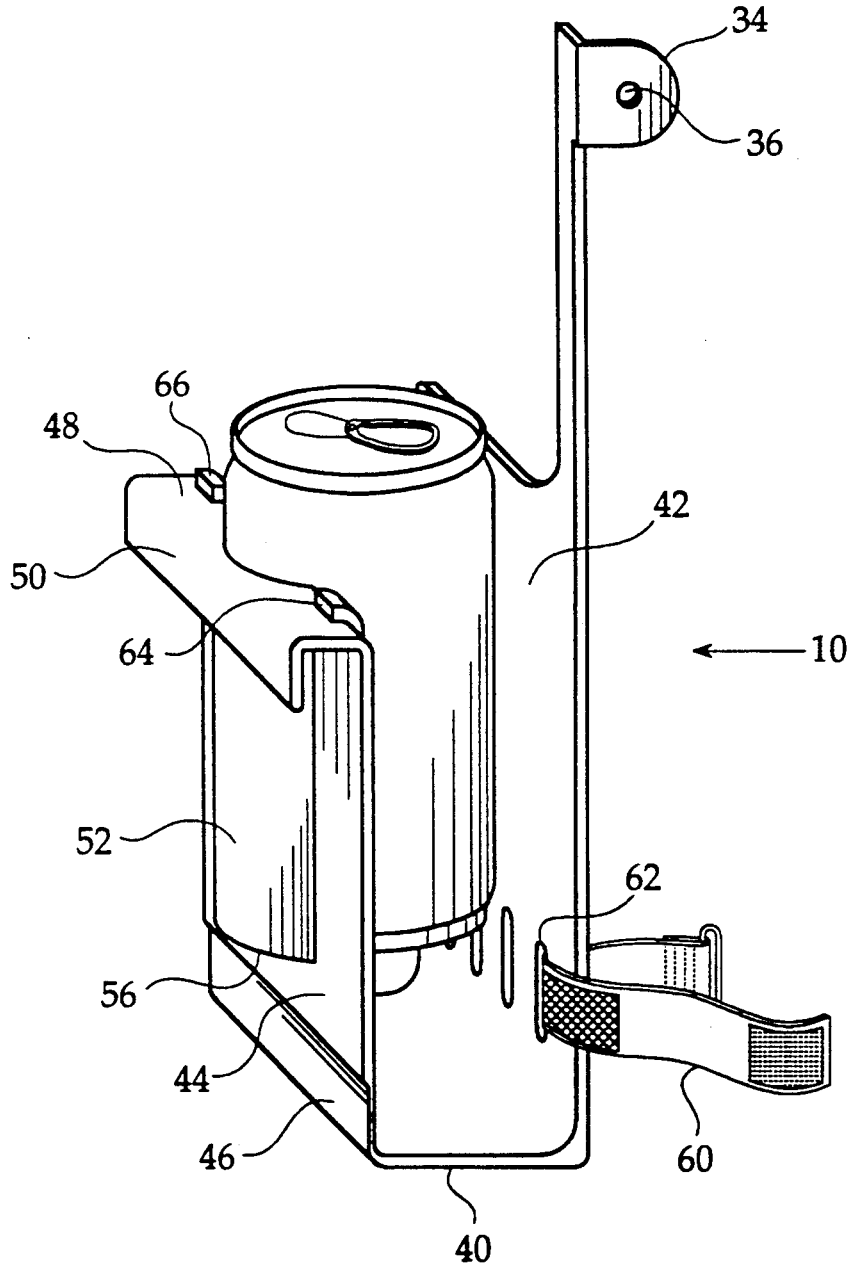
FIG. 4 is a perspective view of a preferred embodiment of the present invention, showing a beverage can clamped in a single-piece carrying device.

FIGS. 3 and 4 show many of the features of a preferred embodiment of the present invention. FIG. 3 shows carrying device 10 as a single molded plastic part. At the top is single attachment bracket 34. Bracket 34 connects to J-shaped member 40, which has a longer leg 42 and a shorter leg 44. At the base of leg 44 is a thinned portion 46 extending the full width of J-shaped member 40. Thinned portion 46 enables leg 44 to be resilient and bend relative to rigid leg 42.

Leg 44 has an outer end 48 to which is connected finger grip 50 extending the full width of J-shaped member 40. In the center of leg 44 is a semicircular protrusion 52 forming a concave recessed surface 54 for supporting a 12 oz. beverage can. Protrusion 52 has an open upper end and a ledge 56 at its lower end. Surface 54 has an axis of curvature parallel to leg 44. The radius of surface 54 is substantially the same as that of a 12 oz. beverage can. Approximately 105° of a 12 oz. beverage can circumference contacts surface 54 when placed against this surface. The spacing of leg 44 from leg 42 is such that when a 12 oz. beverage can is placed against surface 54, as shown in FIG. 4, resilient leg 44, surface 54, and the cylindrical beverage can wall are substantially parallel to rigid leg 42. This permits surface 54 to have maximum contact area with the surface of the beverage can in order to minimize crushing forces against the can.

FIG. 4 also shows strap 60 extending from the lower end of leg 42 through slot 62. Additional slots 62 are shown in FIG. 4 for adapting strap 60 to fit crutch 12 anywhere along its length. The ends of strap 60 may be joined by hook and loop thistle-type fasteners or other common adjustable connecting methods. Strap 60 is intended to hold the lower end of J-shaped member 40 against the outside of the crutch frame so that it cannot pivot about single attachment bracket 34 and bang against the crutch. FIG. 3 shows strap 60 securing carrying device 10 to crutch frame member 16.

FIG. 3 shows carrying device 10 without the beverage can or any other article being held within it. The J-shaped member 40 of carrying device 10 is preferably either molded with leg 44 angled toward leg 42, or is molded with legs parallel and then leg 44 is post-formed toward leg 42, such that outer end 48 of leg 44 nearly contacts the clamp surface of leg 42. Spacers 64 and 66 are attached to the outer end 48 of leg 44, adjacent to protrusion 52, to fill the gap between outer end 48 and leg 42 as formed. If spacers 64 and 66 are thicker than the gap as formed, resilient leg 44 will bend at thinned portion 46 to accommodate the spacers. In this way a preload force will be provided by spacers 64 and 66, allowing resilient leg 44 to clamp thin articles between spacers 64 and 66 and the clamp surface of leg 42. Alternative clamp configurations may have spacers attached to both leg 44 and leg 42 to fill the gap, or may have only spacers attached to leg 42. In any case the purpose of the spacers is to generate a clamping preload force for holding thin articles against leg 42. The length of leg 44 is such that a thin article the size of a business folder is clamped at about its center.

The preload force of the present invention is preferably at least 200 grams as measured perpendicular to leg 42 in order to firmly clamp thin articles while moving the crutch. Also, spacers 64 and 66 preferably have high surface coefficients of friction to prevent articles sliding between the clamping surfaces. When leg 44 is fully opened to clamp a 12 oz. beverage can, the clamping force is preferably less than 1000 grams so that the crutch user can easily open the clamp with one hand to remove the beverage can, and so that an empty can is not crushed. The desired resiliency of leg 44 is established by designing the thickness of thinned portion 46 according to the flexural modulus of the carrying device material and the dimensions of leg 44.

Figure 5:
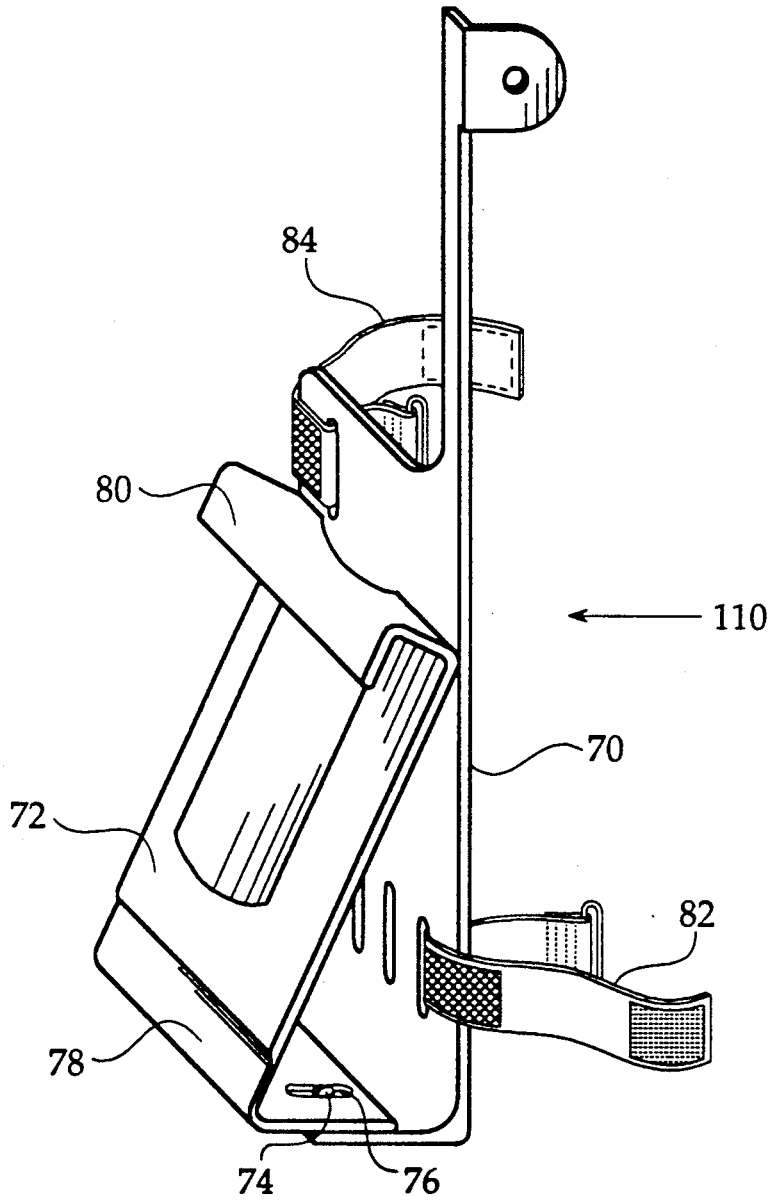
FIG. 5 is a perspective view of another preferred embodiment of the present invention, showing a two-piece carrying device connected together with slidable preload adjustment.

FIG. 5 shows a two-piece embodiment of a carrying device of the present invention, generally indicated as 110. A long rigid leg 70 is an L-shaped member having at least two holes across the horizontal part of the L. Overlapping the horizontal part of the L-shaped member 70 is a short resilient clamp member 72, having a mating horizontal part. Slots 76 in the horizontal part of member 72 align with the holes in member 70, such that member 72 is slidably adjustable toward member 70. Bolts such as bolt 74 and wingnuts, not shown, fasten members 70 and 72 together through the slots and holes. In this preferred embodiment of the present invention, spacers are avoided between resilient leg 72 and rigid leg 70 because the two parts are molded separately. Adjustment of member 72 against member 70 generates the desired preload force for clamping. Resilient leg 72 preferably has thinned portion 78 and finger grip 80 similar to the single-piece J-shaped embodiment of the present invention. A strap 82 is shown at the bottom of member 70 for holding member 70 against one crutch frame member. Another strap 84 is shown on the opposite side of member 70 for securing member 70 to the other crutch frame member.

Figure 6:
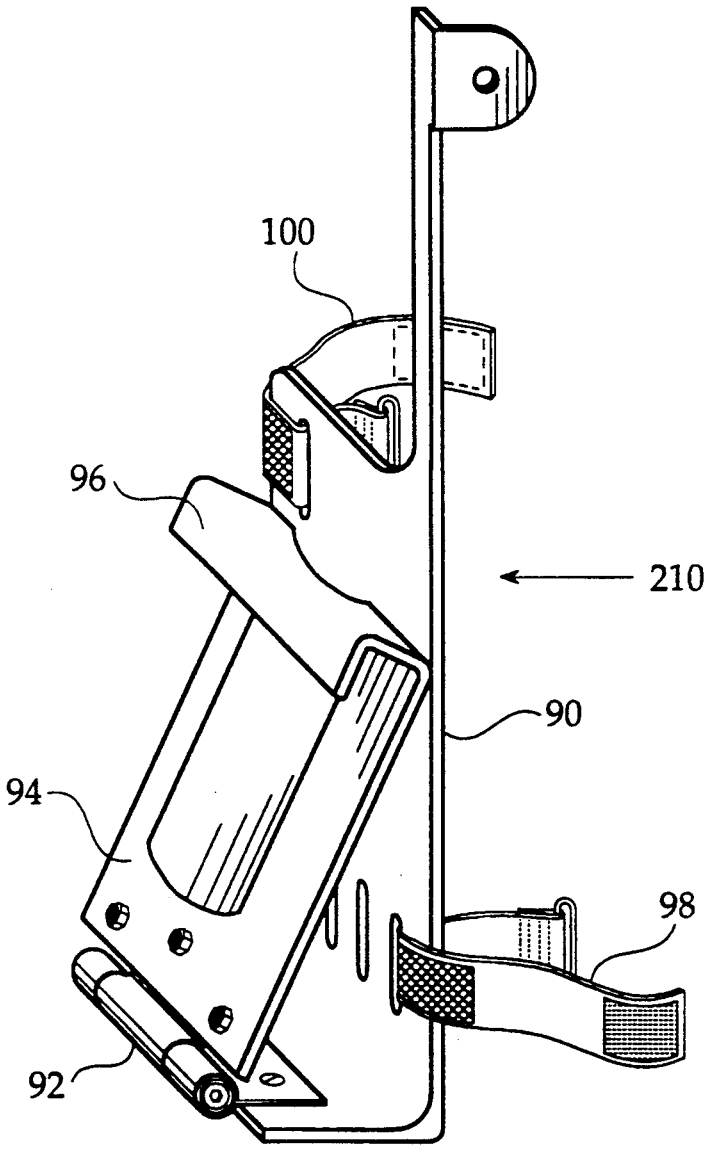
FIG. 6 is a perspective view of still another preferred embodiment of the present invention, showing a two-piece carrying device having a spring-biased hinge connecting the two pieces.

FIG. 6 shows a hinged embodiment of a carrying device of the present invention, generally indicated as 210. A long rigid leg 90 is an L-shaped member with one side of a spring-loaded hinge 92 attached to the end of the horizontal part of the L. A rigid clamp member 94 is attached to the other side of the spring-loaded hinge 92. Spring-loaded hinge 92 biases clamp member 94 against leg 90 with the desired preload force. The spring of hinge 92 is either designed with the desired resiliency or has an adjustable preload force. Clamp member 94 has finger grip 96 for the user to open the clamp. A strap 98 is shown at the bottom of member 90 for holding member 90 against one crutch frame member. Another strap 100 is shown on the opposite side of member 90 for securing member 90 to the other crutch frame member.

In the first preferred embodiment, single-piece carrying device 10 is made of polycarbonate, commonly used for structural members subject to flexure. Bracket 34 is preferably 3 mm thick. Hole 36 is preferably 6 mm in diameter for clearance for bolt 30. It is centered about 20 mm from the clamping surface of leg 42. Bracket 34 is about 35 mm high and deep. Leg 42 is preferably 5 mm thick and 140 mm wide and 300 mm long. A cutout in leg 42 extends 80 mm below the centerline of hole 36 for handgrip grasping clearance. Leg 44 is preferably 140 mm long. The contact point between leg 42 and outer end 48 of leg 44 is about 130 mm from the bottom of leg 42. Leg 44 is angled about 16° toward leg 42 when the clamp is closed in its preloaded position.

For polycarbonate, the thinned portion 46 of leg 44 is preferably 1 mm thick by 25 mm long by 140 mm wide in order to provide a preload force of 230 grams and a fully open load of 900 grams while bending stresses remain below the 9000 psi yield strength of the polycarbonate material. When leg 44 is deflected from its preload position to its fully opened position, leg 44 is parallel to leg 42. Spacers 64 and 66 are preferably 20 mm thick to provide the desired preload force.

Protrusion 52 is about 75 mm long by 65 mm wide by 20 mm deep. The radius of surface 54 is preferably 33 mm. Finger grip 50 extends outward beyond protrusion 52, about 25 mm from leg 44 so that a finger or thumb can easily be inserted under the lip of the finger grip.

Six equally-spaced vertical slots 40 mm long and 7 mm wide and spaced about 12 mm apart are centered about 40 mm above the bottom of J-shaped member 40 in leg 42. These slots are for strap 60. Different slots are used depending on the convergence of the crutch frame member 16 to which strap 60 is attached. Strap 60 is preferably made of cloth with hook and loop thistle-type fastener patches sewn to it. It may be 30 mm wide and thin enough to pass through the vertical slots. Strap 60 is preferably 150 mm long.

In a second embodiment of the present invention having the spring-loaded hinge 92 replacing the thinned portion 46 for resiliency, hinge 92 is preferably a 102 mm long Model no. 426-R door hinge, with closer body R-7189, made by C. Hager & Sons Hinge Manufacturing Company of St. Louis, Mo. This hinge has an adjustable preloading capability. Hinge 92 is preferably bolted to long rigid leg 90 and to clamp member 94.

It is thought that the carrying device attachable to a crutch of the present invention, and many of its attendant advantages, will be understood from the foregoing description; and it will be apparent that various changes may be made in form, construction, and arrangement without departing from the spirit and scope of the invention or sacrificing all of its material advantages, the forms hereinbefore described being merely preferred or exemplary embodiments thereof.

What is claimed is:

1. A carrying device attachable to a crutch, said carrying device comprising:

a.) a J-shaped clamp, said J-shaped clamp having a substantially rigid longer leg and a shorter leg, said longer leg having an upper end, a lower end, and a clamp surface therebetween, said shorter leg having an outer end and an inner end, said inner end flexibly connected to said lower end of said longer leg;

b.) means for biasing said shorter leg relative to said rigid longer leg so that said outer end of said shorter leg presses against said clamp surface of said longer leg with a preload force, so that thin, non-rigid articles may be firmly held by said clamp;

c.) means for manually opening said clamp to permit inserting or removing articles therefrom; and d.) means for attaching said upper and lower ends of said longer leg of said J-shaped clamp to a crutch.

2. The carrying device of claim 1 wherein said means for attaching said J-shaped clamp to a crutch comprises:

a.) a bracket connected to said upper end of said longer leg, said bracket having a single attachment point for attaching said J-shaped clamp to a crutch a fixed distance below the adjustable handgrip of said crutch; and b.) at least one adjustable strap connected to said lower end of said longer leg, said strap holding said lower end against said crutch so that said J-shaped clamp cannot pivot about said single bracket attachment point and bang against said crutch when said crutch is used.

3. The carrying device of claim 1 wherein said shorter leg of said J-shaped clamp further comprises: a semicircular protrusion in the center of said shorter leg, said protrusion forming a concave recess, said recess having an open upper end and a lower end closed by a ledge substantially perpendicular to said shorter leg, said recess having a curvature substantially matching that of a 12 oz. beverage can so that a beverage can may rest upright on said ledge and be clamped against said clamp surface of said longer leg without crushing said beverage can.

4. The carrying device of claim 1 wherein said means for biasing comprises:

a.) a thinned portion at said inner end of said shorter leg, said thinned portion providing resilience to said shorter leg relative to said rigid longer leg, said shorter leg formed so as to angle upward toward said clamp surface of said longer leg so that said outer end of said shorter leg nearly contacts said clamp surface of said longer leg, forming a gap therebetween; and b.) at least one spacer connected to said outer end of said shorter leg, said spacer having sufficient thickness to more than fill said gap, said spacer causing said shorter leg to bend away from said clamp surface and provide a preload force between said resilient leg and said rigid leg substantially normal to said clamp surface.

5. The biasing means of claim 4 wherein said thinned portion of said shorter leg comprises a material having a yield strength greater than the bending stress generated by fully opening said clamp, said thinned portion sized to provide a preload force of at least 200 grams at said clamping surface, yet providing a clamping force of 1000 grams or less when said shorter leg and said longer leg are parallel.

6. The carrying device of claim 1 wherein said means for biasing comprises:

a.) a thinned portion at said inner end of said shorter leg, said thinned portion providing resilience to said shorter leg relative to said rigid longer leg, said shorter leg formed so as to angle upward toward said clamp surface of said longer leg so that said outer end of said shorter leg nearly contacts said clamp surface of said longer leg; and b.) a slidable connection between said inner end of said shorter leg and said lower end of said longer leg, said slidable connection providing adjustment substantially perpendicular to said clamp surface so that said outer end of said shorter leg may be pressed against said clamp surface of said longer leg to bend said thinned portion to cause a preload force at said clamp surface, said slidable connection also having fastening means for fixing the position of said shorter leg relative to said longer leg once preload force adjustment has been completed.

7. The biasing means of claim 6 wherein said thinned portion of said shorter leg comprises a material having a yield strength greater than the bending stress generated by fully opening said clamp, said thinned portion sized to provide a preload force of at least 200 grams at said clamping surface, yet providing a clamping force of 1000 grams or less when said shorter leg and said longer leg are parallel.

8. The carrying device of claim 1 wherein said means for biasing comprises a spring-loaded hinge connected between said inner end of said shorter leg and said lower end of said longer leg, said spring-loaded hinge adjusted to provide a preload force of at least 200 grams at said clamping surface, yet providing a clamping force of less than 1000 grams when said shorter leg and said longer leg are parallel.

9. A carrying device on a crutch comprising:

a.) a crutch having an adjustable handgrip;

b.) a J-shaped clamp attached to said crutch, said J-shaped clamp having a substantially rigid longer leg and a shorter leg, said longer leg having an upper end, a lower end, and a clamp surface therebetween, said shorter leg having an outer end and an inner end, said inner end flexibly connected to said lower end of said longer leg;

c.) means for biasing said shorter leg relative to said rigid longer leg so that said outer end of said shorter leg presses against said clamp surface of said longer leg with a preload force, so that thin, non-rigid articles may be firmly held by said clamp;

d.) means for manually opening said clamp to permit inserting or removing articles therefrom; and e.) a bracket connected to said upper end of said longer leg, said bracket having a single attachment point for attaching said J-shaped clamp to said crutch a fixed distance below said adjustable handgrip of said crutch; and f.) at least one adjustable strap connected to said lower end of said longer leg, said strap holding said lower end against said crutch so that said J-shaped clamp cannot pivot about said single bracket attachment point and bang against said crutch when said crutch is used.

10. The carrying device on a crutch of claim 9 wherein said shorter leg of said J-shaped clamp further comprises: a semicircular protrusion in the center of said shorter leg, said protrusion forming a concave recess, said recess having an open upper end and a lower end closed by a ledge substantially perpendicular to said shorter leg, said recess having a curvature substantially matching that of a 12 oz. beverage can so that a beverage can may rest upright on said ledge and be clamped against said clamp surface of said longer leg without crushing said beverage can.

11. The carrying device on a crutch of claim 9 wherein said means for biasing comprises:

a.) a thinned portion at said inner end of said shorter leg, said thinned portion providing resilience to said shorter leg relative to said rigid longer leg, said shorter leg formed so as to angle upward toward said clamp surface of said longer leg so that said outer end of said shorter leg nearly contacts said clamp surface of said longer leg, forming a gap therebetween; and b.) at least one spacer connected to said outer end of said shorter leg, said spacer having sufficient thickness to more than fill said gap, said spacer causing said shorter leg to bend away from said clamp surface and provide a preload force between said resilient leg and said rigid leg substantially normal to said flat face.

12. The biasing means of claim 11 wherein said thinned portion of said shorter leg comprises a material having a yield strength greater than the bending stress generated by fully opening said clamp, said thinned portion sized to provide a preload force of at least 200 grams at said clamping surface, yet providing a clamping force of 1000 grams or less when said shorter leg and said longer leg are parallel.

13. The carrying device on a crutch of claim 9 wherein said means for biasing comprises:

a.) a thinned portion at said inner end of said shorter leg, said thinned portion providing resilience to said shorter leg relative to said rigid longer leg, said shorter leg formed so as to angle upward toward said clamp surface of said longer leg so that said outer end of said shorter leg nearly contacts said clamp surface of said longer leg; and b.) a slidable connection between said inner end of said shorter leg and said lower end of said longer leg, said slidable connection providing adjustment substantially perpendicular to said clamp surface so that said outer end of said shorter leg may be pressed against said clamp surface of said longer leg to bend said thinned portion to cause a preload force at said clamp surface, said slidable connection also having fastening means for fixing the position of said shorter leg relative to said longer leg once preload force adjustment has been completed.

14. The biasing means of claim 13 wherein said thinned portion of said shorter leg comprises a material having a yield strength greater than the bending stress generated by fully opening said clamp, said thinned portion sized to provide a preload force of at least 200 grams at said clamping surface, yet providing a clamping force of 1000 grams or less when said shorter leg and said longer leg are parallel.

15. The carrying device on a crutch of claim 9 wherein said means for biasing comprises a spring-loaded hinge connected between said inner end of said shorter leg and said lower end of said longer leg, said spring-loaded hinge adjusted to provide a preload force of at least 200 grams at said clamping surface, yet providing a clamping force of less than 1000 grams when said shorter leg and said longer leg are parallel.

16. A carrying device attachable to a crutch, said carrying device comprising:

a.) a J-shaped member having a rigid longer leg with an upper end and a lower end and a clamp surface therebetween, said J-shaped member also having a shorter leg connected to said lower end of said longer leg, said shorter leg having an outer end and a thinned portion where said shorter leg connects to said longer leg, said thinned portion providing resilience to said shorter leg relative to said rigid longer leg, said shorter leg formed so as to angle upward toward said clamp surface of said longer leg so that said outer end of said shorter leg nearly contacts said clamp surface of said longer leg, forming a gap therebetween;

b.) at least one spacer connected to said outer end of said shorter leg, said spacer having sufficient thickness to more than fill said gap, said spacer causing said shorter leg to bend away from said clamp surface and provide a preload force between said resilient leg and said rigid leg substantially normal to said clamp surface, so that thin, non-rigid articles may be firmly clamped in said carrying device;

c.) a finger grip attached to said shorter leg for manually opening said clamp to permit inserting or removing articles therefrom;

d.) a bracket connected to said upper end of said longer leg, said bracket having a single attachment point for attaching said J-shaped member to a crutch a fixed distance below the adjustable handgrip of said crutch; and e.) at least one adjustable strap connected to said lower end of said longer leg, said strap holding said lower end against said crutch so that said J-shaped member cannot pivot about said single bracket attachment point and bang against said crutch when said crutch is used.

17. The carrying device of claim 16 wherein said thinned portion of said shorter leg comprises a material having a yield strength greater than the bending stress generated by fully opening said clamp, said thinned portion sized to provide a preload force of at least 200 grams at said clamping surface, yet providing a clamping force of 1000 grams or less when said shorter leg and said longer leg are parallel.

18. The carrying device of claim 16 wherein said shorter leg of said J-shaped member further comprises: a semicircular protrusion in the center of said shorter leg, said protrusion forming a concave recess, said recess having a lower end closed by a ledge substantially perpendicular to said shorter leg, said recess having a curvature substantially matching that of a 12 oz. beverage can so that a beverage can may rest upright on said ledge and be clamped against said clamp surface of said longer leg without crushing said beverage can.

* * * * *